US006234817B1

(12) United States Patent
Hwang

(10) Patent No.: US 6,234,817 B1
(45) Date of Patent: May 22, 2001

(54) BLIND-MATE, FLOATABLE CONNECTORS ASSEMBLY

(75) Inventor: Jenq-Yih Hwang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/302,019

(22) Filed: Apr. 29, 1999

(51) Int. Cl.[7] ..... H01R 13/64
(52) U.S. Cl. ..... 439/247; 439/248
(58) Field of Search ..... 439/247, 246, 439/248, 544, 545, 31, 74, 83, 65, 66

(56) References Cited

U.S. PATENT DOCUMENTS 4,761,144 * 8/1988 Hunt, III et al. ..... 439/545
4,929,185 * 5/1990 Wong et al. ..... 439/74
4,998,887 * 3/1991 Kaufman et al. ..... 439/78
5,106,313 * 4/1992 Lwee et al. ..... 439/135
5,184,964 * 2/1993 Douty et al. ..... 439/247
5,928,003 * 7/1999 Kajunuma ..... 439/74
6,017,233 * 1/2000 Fry et al. ..... 439/248

* cited by examiner

*Primary Examiner*—Gary F. Paumen
*Assistant Examiner*—Alexander Gilman
(74) *Attorney, Agent, or Firm*—Wei Te Chung

(57) ABSTRACT

An electrical system comprises first and second substrates electrically connected by means of first and second connectors mounted on the substrates, respectively. Each first connector includes a cavity having an array of first terminals disposed therein. Each second connector includes a mating portion having second terminals received in the cavity when the first and second connectors are mated. Floatable means arranged at least on the first connector such that when the first (floatable) connector is mated to the corresponding second connector of the second substrate, the first (floatable) connector is moveable respect to the corresponding second connector to compensate any misalignment therebetween thereby ensuring an electrical connection between the first and second connectors.

2 Claims, 6 Drawing Sheets

BLIND-MATE, FLOATABLE CONNECTORS ASSEMBLY

FIELD OF THE INVENTION

The present invention relates to a connector assembly, and more particularly to a blind-mate floatable connectors assembly.

DESCRIPTION OF PRIOR ART

Board-to-board connectors are used to connect two printed circuit boards having a plurality of electrical components mounted thereon. In the past, each printed circuit board is mounted with one receptacle connector to mate with a plug connector mounted on the other printed circuit board. When more than two receptacle connectors are mounted on the printed circuit board and are to mate with corresponding plug connectors on the corresponding printed circuit board, accurate alignment between the receptacle and plug connectors is vital to reliable electrical connection therebetween. If one pair of receptacle and plug connectors is misaligned because of tolerance, improper electrical connection will be raised therebetween.

In order to solve this problem, one of the approaches is to provide a receptacle connector having a floatable portion to compensate the misalignment to the plug connector. Another approach is to provide a receptacle connector in which terminals are movable to compensate the misalignment. Both of these approaches are expensive and unpractical, especially in compact and high density connector.

SUMMARY OF THE INVENTION

An objective of this invention is to provide a receptacle and plug connectors assembly used between two printed circuit boards having floatable means mounted thereon such that misalignment therebetween can be correctly compensate thereby ensuring effective electrical connection therebetween.

In order to achieve the objective set forth, an electrical system comprises first and second substrates electrically connected by means of first and second connectors mounted on the substrates, respectively. Each first connector includes a cavity having an array of first terminals disposed therein. Each second connector includes a mating portion having second terminals received in the cavity when the first and second connectors are mated. Floatable means arranged at least on the first connector such that when the first (floatable) connector is mated to the corresponding second connector of the second substrate, the first (floatable) connector is moveable respect to the corresponding second connector to compensate any misalignment therebetween thereby ensuring an electrical connection between the first and second connectors.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
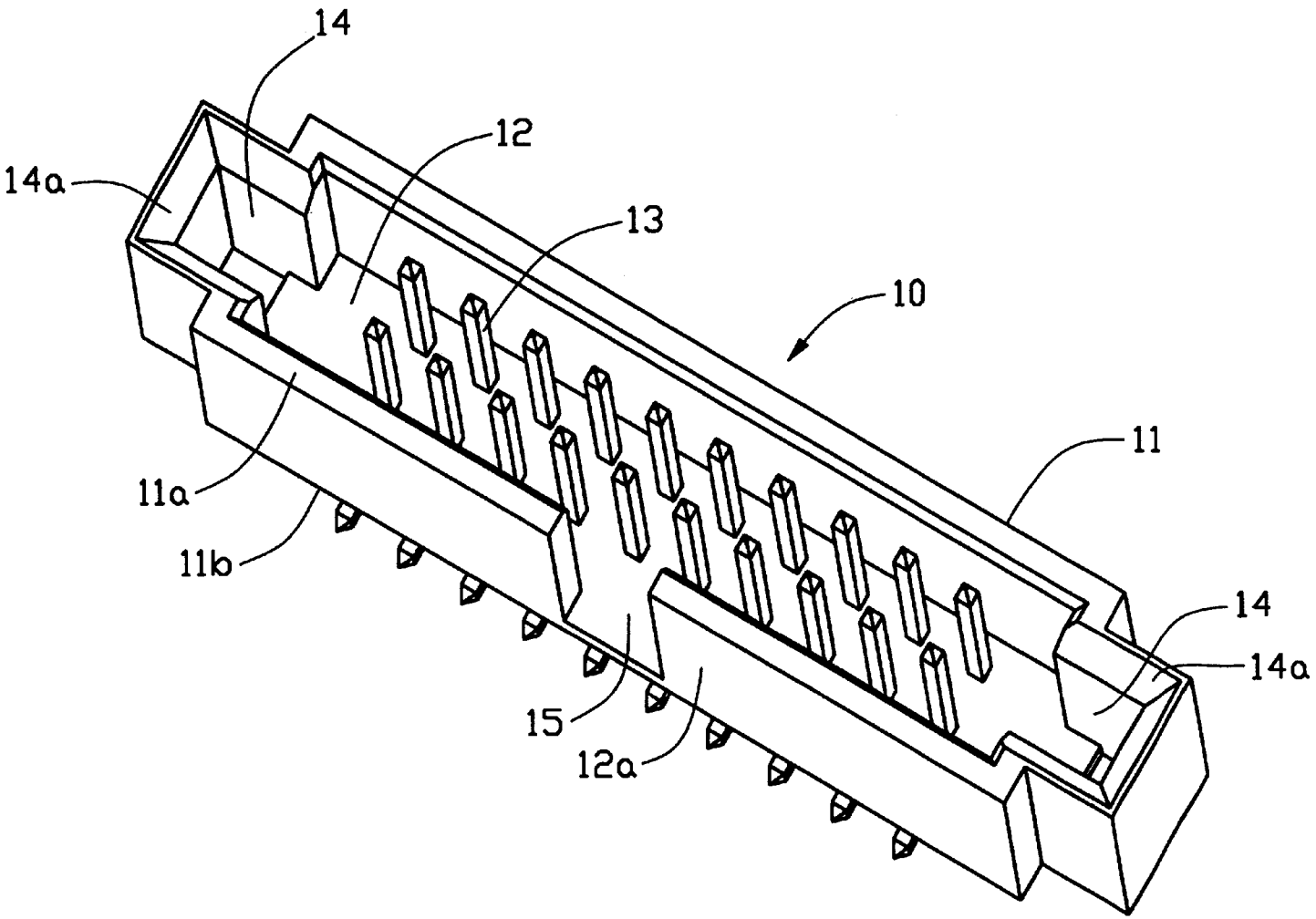
FIG. 1 is a perspective view of a plug connector in accordance with the present invention.
Figure 2:
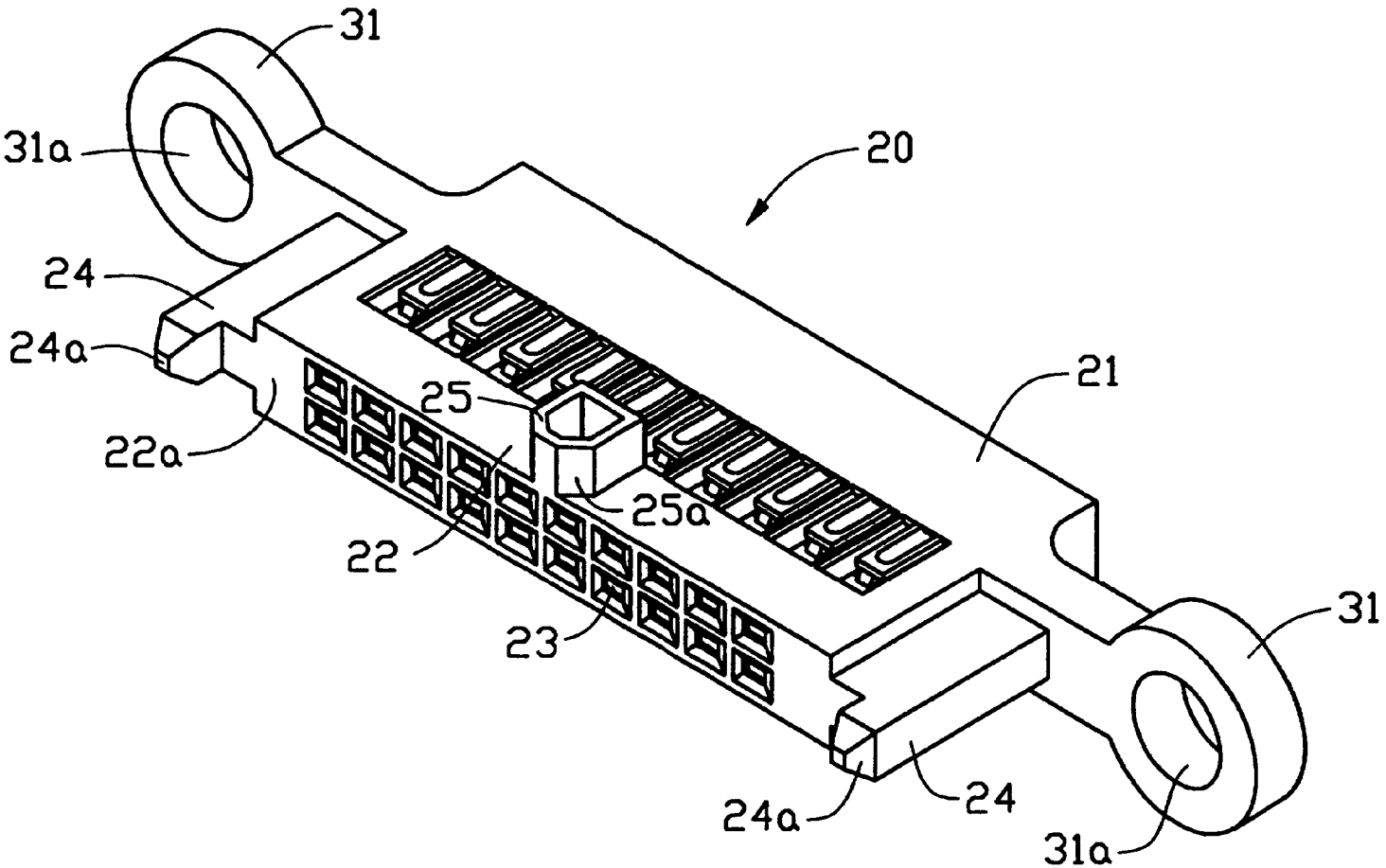
FIG. 2 is a perspective view of a receptacle connector corresponding to the plug connector of FIG. 1.
Figure 3:
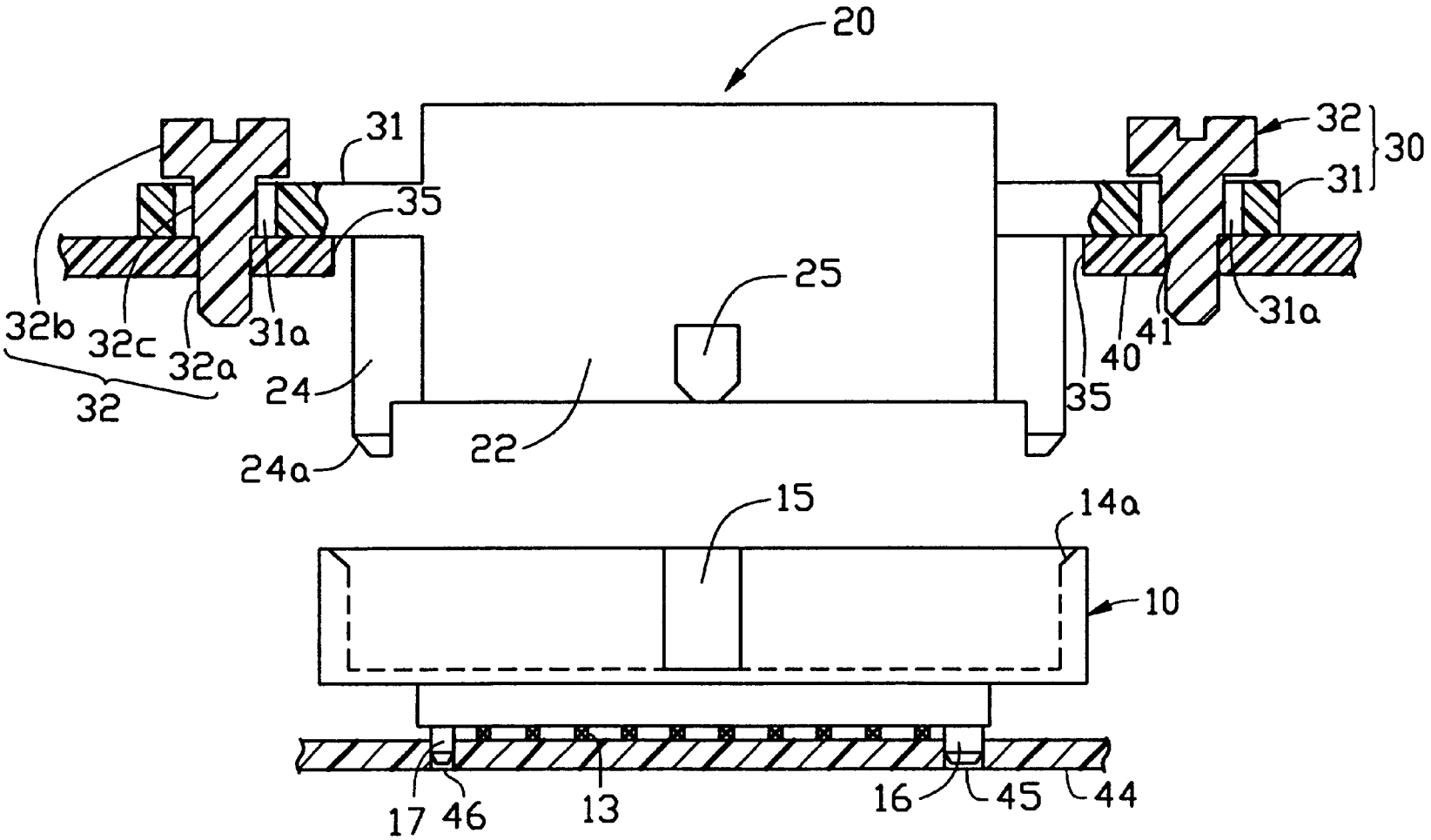
FIG. 3 is a front view before the plug and receptacle connectors are mated.
Figure 4:
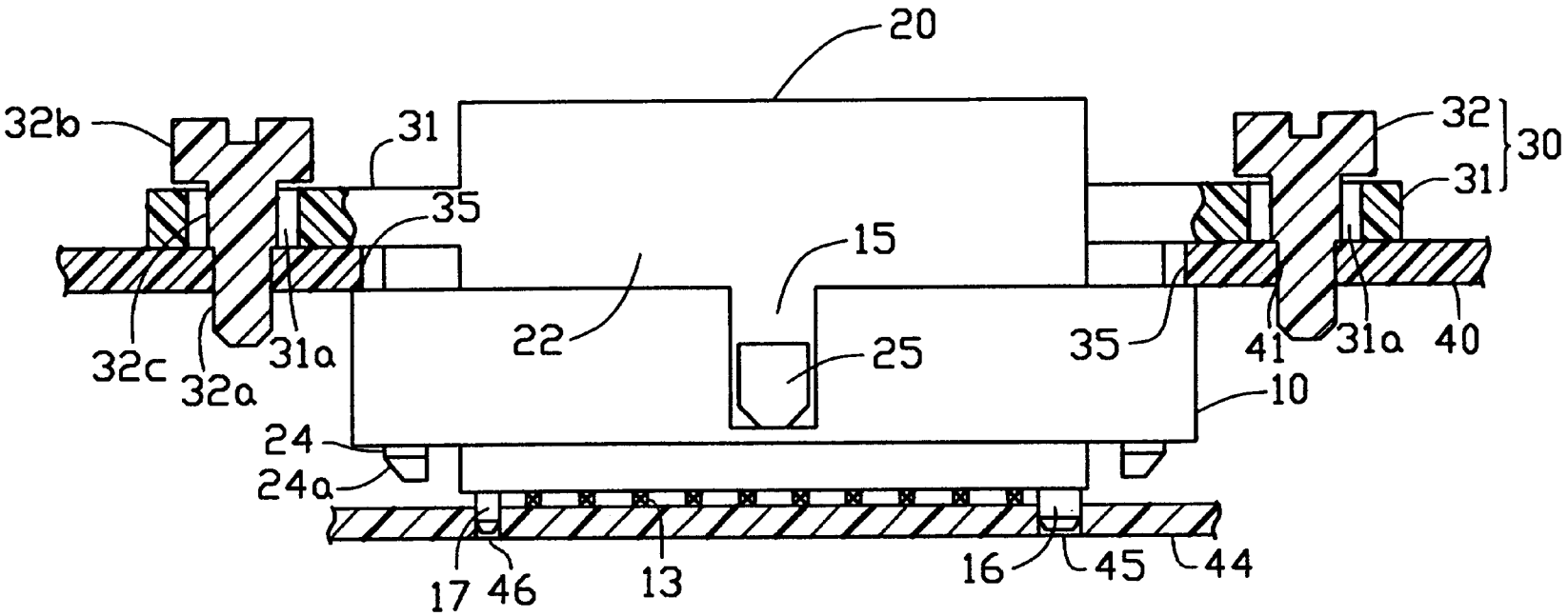
FIG. 4 is a front view after the plug and receptacle connectors are mated.

Referring to FIGS. 1, 2, 3 and 4, a self-aligned floatable connector assembly 1 in accordance with the present invention comprises a receptacle connector 10 including a first housing 11 having front and rear faces 11*a*, 11*b*. A cavity 12 defined in the front face and having an array of first terminals 13 disposed therein. A pair of receiving passages 14 is formed on opposite ends of the housing 11 and each communicates to the cavity 12. Each passage 14 has slanted edges 14*a* for easy entrance therein. The receptacle connector 10 further includes a receiving slot 15 on a wall 12*a* of the cavity 12. The receptacle connector 10 further includes two mounting posts 16, 17 having different outer diameters for ensuring correct insertion to corresponding holes 45, 46 of a printed circuit board 44.

A plug connector 20 mated to the first connector 10 includes a second housing 21 having a mating portion 22 received in the cavity 12. An array of passageways 23 is arranged in the mating portion 22 and each received a second terminal (not shown) therein for electrically engaged with the first terminal 13 when the receptacle and plug connectors 10, 20 are mated. The plug connector 20 includes a pair of guiding rods 24 on opposite ends of the mating portion 22 received in the corresponding receiving passage 14 of the receptacle connector 10. Each guiding rod 24 includes a tapered tip 24*a* extending over a top face 22*a* of the mating portion 22. By the cooperation of the tapered tip 24*a* and the slanted edges 14*a*, mating between the receptacle and plug connectors 10, 20 along a front-to-back direction can be smoothly performed. In addition, a guiding wedge 25 is formed on an outer wall of the mating portion 22 corresponding to the receiving slot 15 of the receptacle connector 10. The guiding wedge 25 includes a pair of chamfered corners 25*a* for easy insertion to the receiving slot 15.

Floatable means 30 is arranged the plug connector 20 such that when the plug connector 20 is moveable to the corresponding receptacle connector 10 when both are mated. The floatable means 30 includes a pair of lugs 31 having an opening 31*a* therein integrally formed on opposite ends of the plug connector 20, and a pair of mounting pins 32. The mounting pin 32 includes a root 32*a* fixedly received in a mounting hole 41 of a printed circuit board 40. The mounting pin 32 further includes an enlarged head 32*b* having a diameter larger than said opening 31*a* of said lug 31 and a stem 32*c* having a diameter smaller than said opening 31*a* of said lug 31 but larger than the mounting hole 41. The height of the stem 33 is larger than the thickness of the printed circuit board 40 thereby the plug connector 20 may freely move or be floatable respect to the printed circuit board 40.

Figure 5:
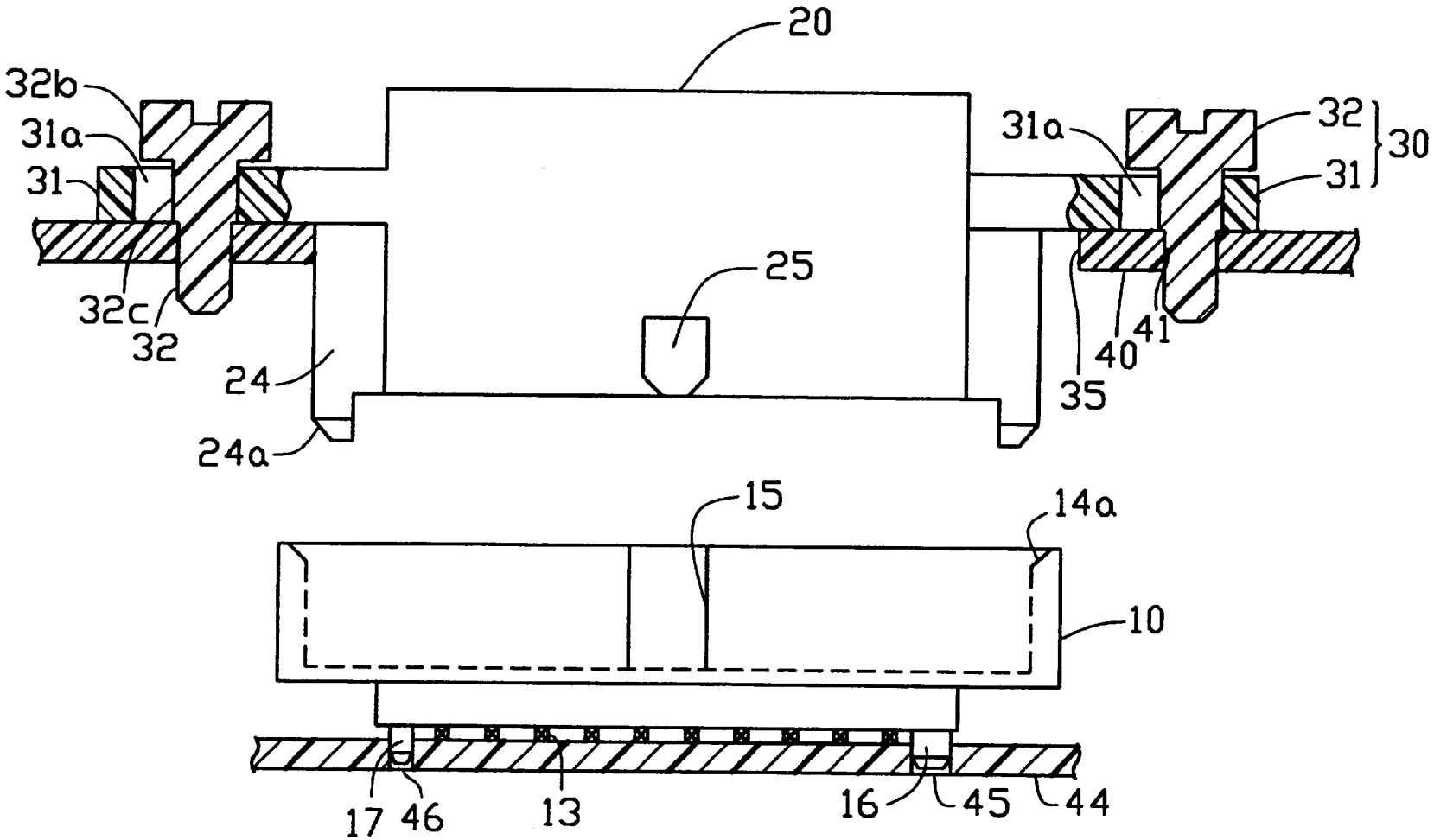
FIG. 5 is a front view showing the plug connector is offset leftward from the receptacle connector.
Figure 6:
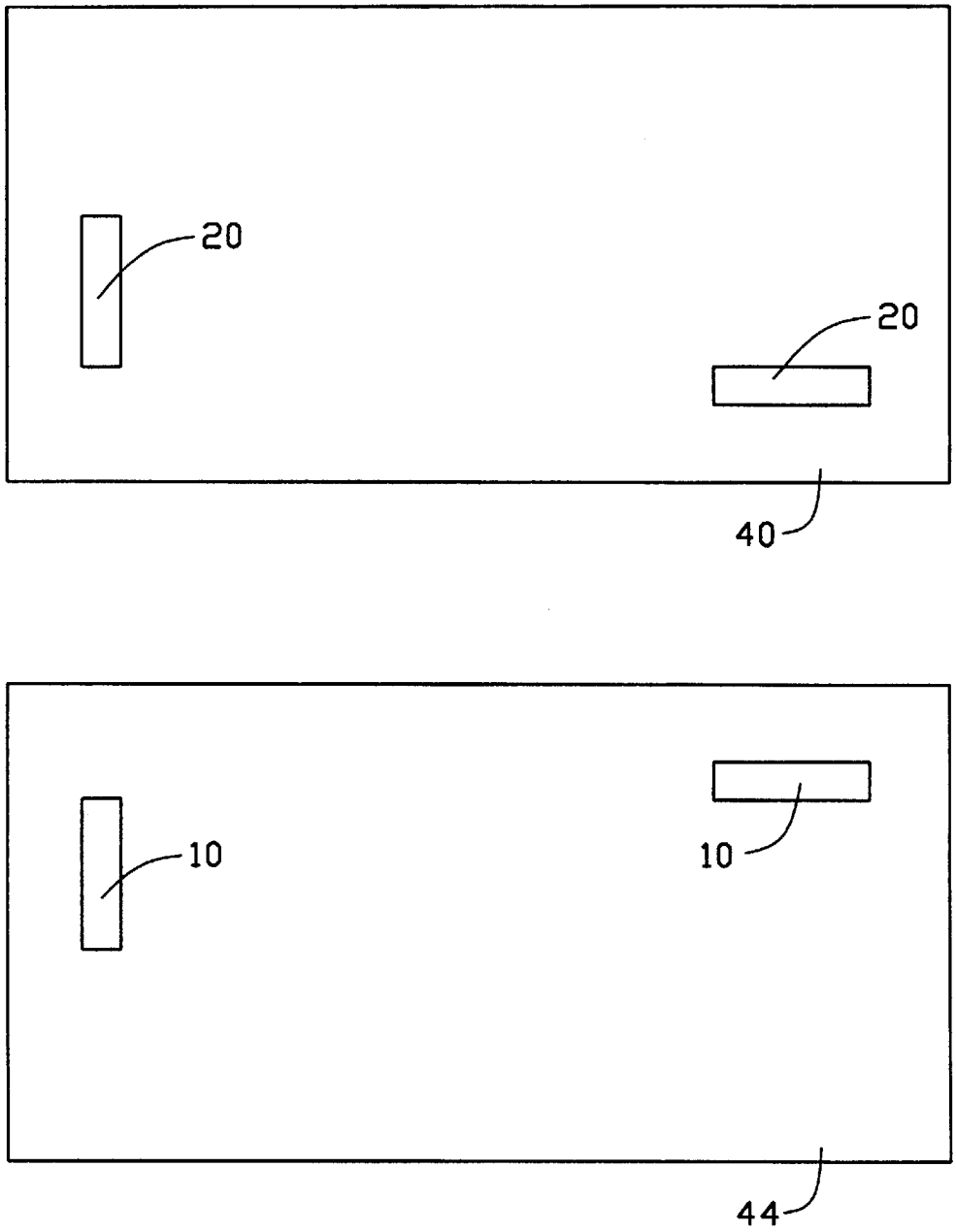
FIG. 6 is a sketch view showing two printed circuit boards mounted with the connectors in accordance with the present invention.

Referring to FIGS. 5 and 6, two printed circuit boards 44 and 40 are mounted with receptacle and plug connectors 10, 20 respectively. Both the receptacle connectors 10 are fixedly assembled to the printed circuit board 44, while the plug connectors 20 are floatably mounted to the printed circuit board 40 by the floating means 30. No matter the plug connector 20 is offset leftward, FIG. 5, or rightward (not shown), with respect to the receptacle connector 10, by the arrangement of the guiding rods 24, the receiving passage 14, and floatable means 30, the plug connector 20 can be easily aligned with the corresponding receptacle connector 10 thereby ensuring electrical connection therebetween. By this arrangement, the printed circuit boards 44, 40 having more than two plug and receptacle connectors 20, 10 can be easily aligned and mated to ensure reliable electrical connection therebetween.

It can be noted that even though in this embodiment the floating adjustment is shown to be applied along the lengthwise direction of the housing 21, the same implementation is also able to be used in the lateral direction. This feature is more practical when such two pairs of receptacle-plug connectors 10, 20 are mated in a mutually perpendicular arrangement as shown in FIG. 6. By the way the opening 35 of the printed circuit board 40 should be large enough to compensate the deviation of the position of the floating connector 20 with regard to the printed circuit board 40 so that any protrusion portion of the connector 20 extending through such an opening 35 will not interfere with the circuit board 40.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. A self-aligned floatable connector assembly, comprising:

a first connector including a first housing having front and rear faces, a cavity defined in said front face and having an array of first terminals disposed therein;

a second connector received in said cavity of said first connector, said second connector including a second housing having front and rear faces, an array of passageways arranged between said front and rear faces and each receiving a second terminal therein for electrically engaging with said first terminal when said first and second connectors are mated;

a floatable means arranged on said second connector such that when said second connector is assembled to a substrate, said second connector is moveable in all directions with respect to said substrate;

wherein said floatable means includes a pair of lugs integrally formed on opposite ends of said second connector, each lug having an opening therein, and pair of mounting pins attached to said substrate, each mounting pin including an enlarged head having a diameter larger that said opening of said lug and a stem extending through said opening and having a diameter smaller that said opening of said lug;

wherein a blind mating means which formed between said first and second connectors and includes a guiding rod formed on said first connector and a receiving passage formed on said second connector;

wherein an anti-disorientation means which includes a guiding wedge formed on an outer wall of said first connector and a receiving slot corresponding to said guiding wedge formed on said second connector.

2. An electrical system, comprising:

a first substrate having at least two first connectors mounted thereon, each first connector including a first housing having front and rear faces, a cavity defined in said front face and having an array of first terminals disposed therein;

a second substrate having at least two second connectors received in said cavities of said two first connectors, each second connector including a second housing having front and rear faces, an array of passageways arranged between said front and rear faces and each receiving a second terminal therein for electrically engaging with said first terminal when said second second connectors are mated; and a floatable means arranged at least on one said second connectors such that when said second connector is mated to said corresponding first connector of said first substrate, said second connector is moveable in all directions with respect to said corresponding first connector to compensate any misalignment therebetween thereby ensuring an electrical connection between said second and first connectors;

wherein said floatable means includes a pair of lugs integrally formed on opposite ends of said second connector, each lug having an opening therein, and pair of mounting pins attached to said second substrate, each mounting pin including an enlarged head having a diameter larger that said opening of said lug and a stem extending through said opening and having a diameter smaller that said opening of said lug;

wherein blind mating means which formed between said first and second connectors and includes a guiding rod formed on said first connector and a receiving passage formed on said second connector;

wherein an anti-disorientation means which includes a guiding wedge formed on an outer wall of said first connector and a receiving slot corresponding to said guiding wedge formed on said second connector.

* * * * *